United States Patent [19]

Medina et al.

[11] 4,365,801

[45] Dec. 28, 1982

[54] ELEVATIONAL PLATFORM FOR BALANCE BEAMS AND LIKE ARTICLES

[76] Inventors: John A. Medina, 796 Broadmoor Dr., San Jose, Calif. 95129; George G. Pendergast, 7511 Santa Barbara Dr., Gilroy, Calif. 95020

[21] Appl. No.: 193,291

[22] Filed: Oct. 2, 1980

[51] Int. Cl.[3] ..... A63B 7/08

[52] U.S. Cl. ..... 272/111; 108/144; 182/141; 434/247

[58] Field of Search ..... 272/61–66, 272/24, 70, 93, 109–113, 144 1 R; 5/11, 63, 65, 81 R; 182/141–149, 187; 108/144; 434/247

[56] References Cited

U.S. PATENT DOCUMENTS

| | | | |
|---|---|---|---|
| 2,003,581 | 6/1935 | Daly | 182/141 |
| 2,985,891 | 5/1961 | Hutt | 5/11 |
| 3,211,452 | 10/1965 | Ahrens | 272/109 X |
| 3,262,734 | 7/1966 | Kuks | 108/144 X |
| 3,282,376 | 11/1966 | Merriman | 182/141 X |
| 3,305,876 | 2/1967 | Hutt | 5/11 |
| 3,380,085 | 4/1968 | Ferneau et al. | 5/63 X |
| 3,713,652 | 1/1973 | Rakestraw | 272/1 R |
| 3,802,002 | 4/1974 | Jonas | 5/63 X |

FOREIGN PATENT DOCUMENTS

| | | | |
|---|---|---|---|
| 132348 | 6/1929 | Switzerland | 272/111 |
| 737759 | 9/1955 | United Kingdom | 272/64 |

*Primary Examiner*—Richard C. Pinkham
*Assistant Examiner*—Arnold W. Kramer
*Attorney, Agent, or Firm*—Lewis B. Sternfels

[57] ABSTRACT

A platform (10) comprises a deck (12), leg pairs (14) pivoted to the deck, and screw mechanisms (28–38) coupled to the legs for pivoting the legs in unison towards and away from each other, respectively, to lower and raise the deck. The platform is yieldable due to flexibility inherent in the legs, which yieldability increases as the legs depart further from their vertical position. Such yieldability is particularly useful when a pair of such platforms is used as a raisable floor alongside of a balance beam (50) in gymnastic training, for helping the gymnast lose her fear of height, and for enabling a coach safely to spot the gymnast.

15 Claims, 6 Drawing Figures

ELEVATIONAL PLATFORM FOR BALANCE BEAMS AND LIKE ARTICLES

TECHNICAL FIELD

The present invention relates to a height-adjustable platform having spring characteristics and, in particular, to such a platform which is useful for training for gymnasts and like users at a balance beam.

BACKGROUND ART

While the present invention has been designed primarily for use as a training aid for gymnasts in conjunction with a balance beam, it is to be understood that such a specific use is only illustrative of the general field of similar applicability. However, because the genesis of the present invention is for use with such balance beams, the following exposition will reply thereon.

In the training of gymnasts, one of the initial requirements is to help the individual lose her beginner's fear of falling while, at the same time, to permit the coach to be at the same level as the student to spot her, to catch her in case of falling and to otherwise teach her the fundamentals and the proper sequences and controls. This is especially critical at the competition height of about four feet.

Conventionally, the gymnast is at first trained at floor level, using a white line to represent the balance beam. After the student has been sufficiently trained at this level, most coaches begin to continually elevate the beam until it reaches the competition level of approximately 4 feet. Raising the beam in this manner has many pitfalls. First, the fear element for the gymnast increases dramatically as the beam is raised. Secondly, the ability of the coach to help spot and control the gymnast diminishes, since the gymnast is now located above the level of the coach. In the extreme, the feet of the gymnast are at or above the coach's chest. To alleviate this problem, current practice is to elevate the coach alongside the gymnast by such methods as stacking mats on top of one another, or using tables, chairs and other items which are neither safe, economical nor practical. Because of the instability of most such methods, coaches have fallen trying to aid gymnasts, and gymnasts have fallen because the coach had an unstable platform on which to work.

SUMMARY OF THE INVENTION

The present invention overcomes and avoids these and other problems by utilizing a specially designed platform whose height is adjustable. Such a platform comprises a deck with pivotable legs attached thereto. A mechanism coupled to the legs permits them to pivot so that they can be drawn towards or away from one another so as to lower or raise the deck. In such construction, the legs can slightly flex or bend so that, when they are at least slightly pivoted away from the vertical, they will impart a limited spring characteristic to the platform. Such springiness, or yieldability, increases as the platform is lowered, as the result of further angling of the legs away from the vertical. This characteristic is used to advantage because, as the height between the platform and the balance beam is increased, the yieldability of the platform correspondingly increases.

It is, therefore, an advantage of the present invention to provide for a height-adjustable platform, especially useful in the training of gymnasts on a balance beam.

Another advantage is to impart resiliency to such platforms, so that they are yieldable when jumped on.

Another advantage is to increase the platform's resiliency in proportion to an increase in the height between the balance beam and the platform.

Another object is to provide for a means by which the training of gymnasts can be safely accelerated, including rapid alleviation of their fear of height.

As a further advantage, the gymnast can practice safely at competition height, with or without coaching and, when coaching is desired, to provide for a stable platform for the coach at the level of the balance beam.

Still another advantage is to increase the safety of the coach at any level of training on the balance beam.

Another advantage is to provide for balance beam training by use of a floor which can be raised to the beam's height.

With such platforms, gymnasts have lost their fear of falling and have been trained at competition levels in relatively short periods of time. In addition, retraining of the gymnasts after a period of inactivity is greatly accelerated.

Other aims and advantages, as well as a more complete understanding of the present invention, will appear from the following explanation of exemplary embodiments and accompanying drawings thereof.

DETAILED DESCRIPTION OF THE INVENTION

Figure 1:
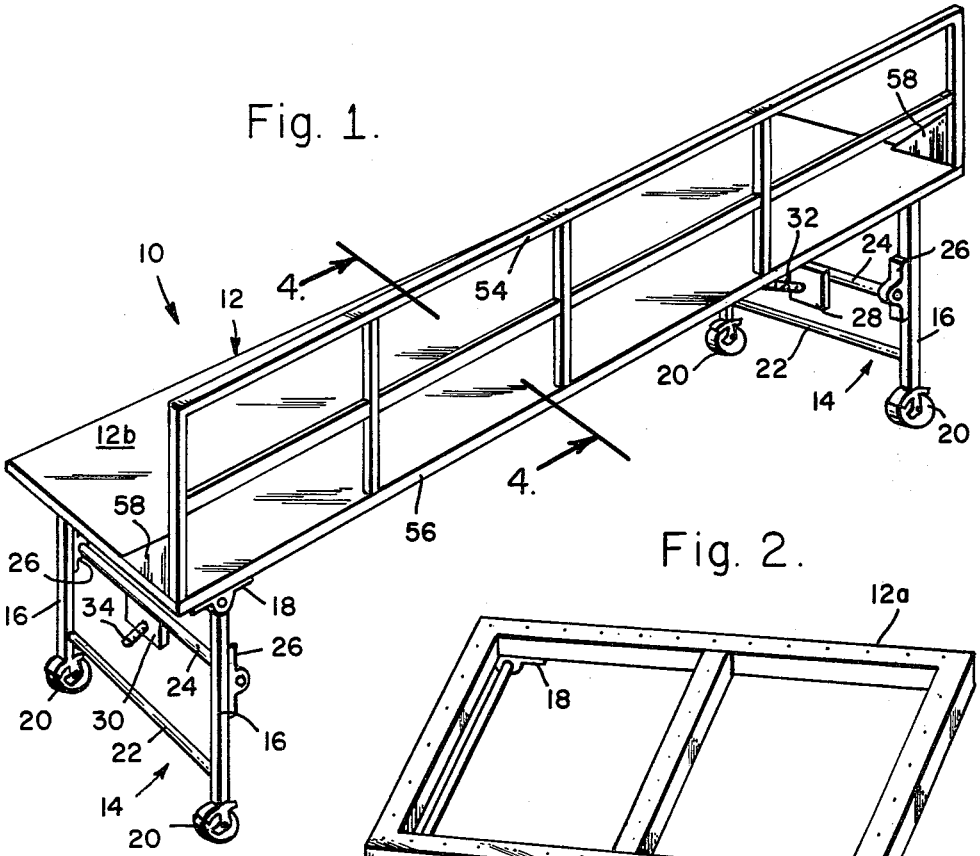
FIG. 1 is a perspective view of a preferred embodiment of the inventive platform.
Figure 2:
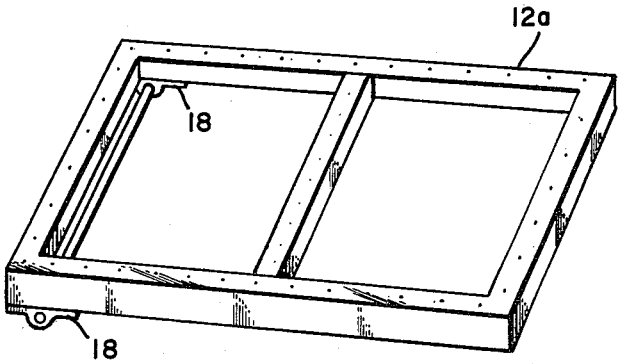
FIG. 2 is a perspective view of one-half of a support frame of the platform deck.
Figure 3:
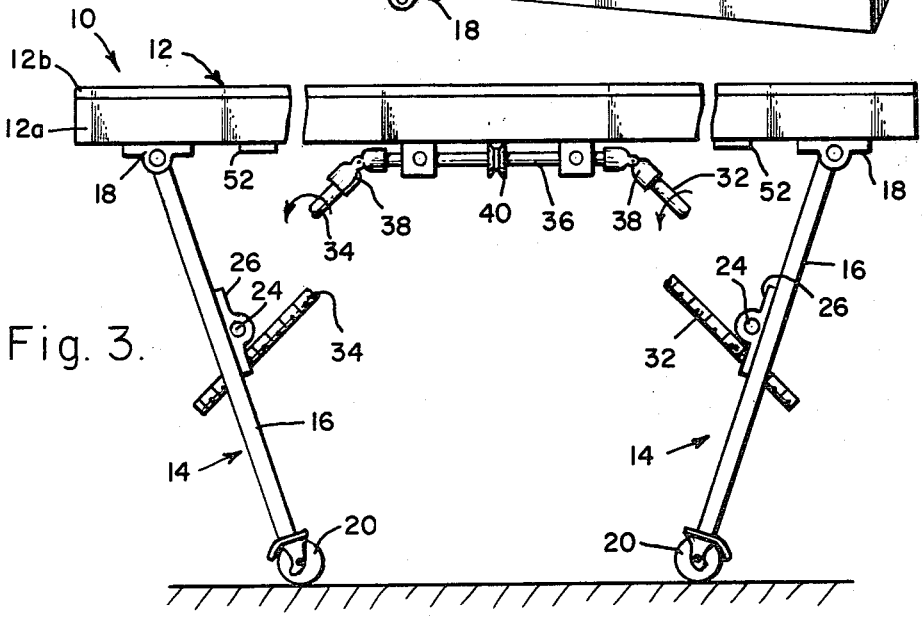
FIG. 3 is a side view of the platform depicted in FIG. 1.

As shown in FIGS. 1–4, a platform 10 comprises a deck 12, comprising a frame **12*a* and a plywood piece or the like 12*b*, to which two pairs 14 of legs 16 are pivoted by means, for example, of pillow blocks 18. It is to be understood, of course, that any other form of pivoting may be used. At the end of the legs which are opposite from their pivot points, a plurality of wheels 20, or the like rotational devices, are attached. As illustrated, deck 12** comprises an open framework covered by a plywood sheet. If desired, resilient material may be placed thereon.

Each leg pair 14 is joined together at its bottom by a brace 22 so that, in combination with their pivot attachments to deck 12, each leg pair forms solid construction. Intermediate to brace 22 and deck 12 is a rotatable rod 24 which is pivotable with respect to leg pairs 14 by means of pillow blocks 26. Centrally located in rods 24 are internally threaded nuts 28 and 30, the threads of one nut being reversed with respect to the other, that is, having left- and right-handed threads. If desired, rods 24 may be fixed with respect to legs 16, and nuts 28 and 30 pivotable with respect to the rods. Extending through nuts 28 and 30 are a pair of threaded shafts or screws 32 and 34 which likewise have reverse threading. The screws are attached to a shaft 36 by means of universal joints 38. Shaft 36 is journaled to deck 12 by any convenient manner. A pulley 40 is secured to shaft 36, while a crank 42 may be secured to either or both of screws 32 and 34. Thus, the combination of screws 32 and 34 and shaft 36 may be rotated either manually by means of crank 42 or by some motorized or other means through the use of pulley 40.

As shaft 36 and screws 32 and 34 are rotated, nuts 28 and 30 are caused to traverse their respective screws, to cause leg pairs 14 to move towards or away from one another in unison. Such movement of the legs causes respective lowering or raising of deck 12. In addition, as leg pairs 14 increasingly move towards one another, they are subjected to greater bending moments from forces exerted on deck 12, which increase the resiliency of the platform.

Figure 5:
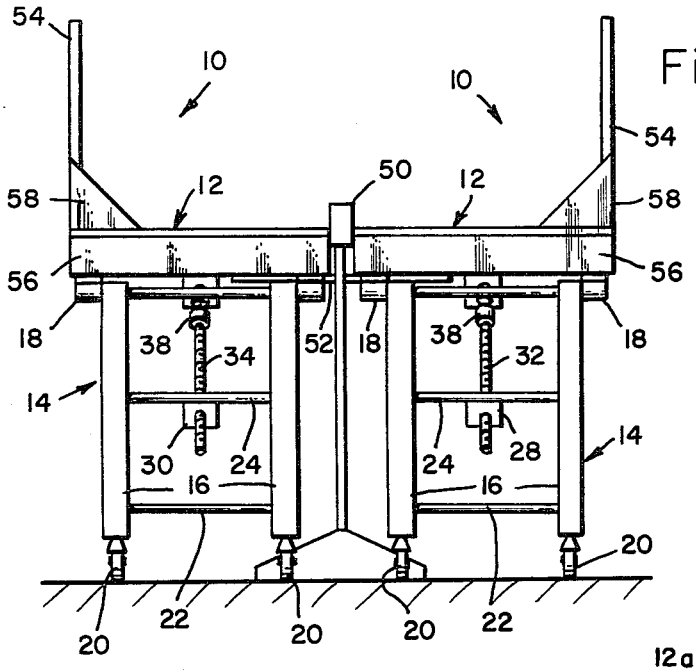
FIG. 5 depicts the combination of a balance beam and a pair of platforms for training the gymnasts.
Figure 4:
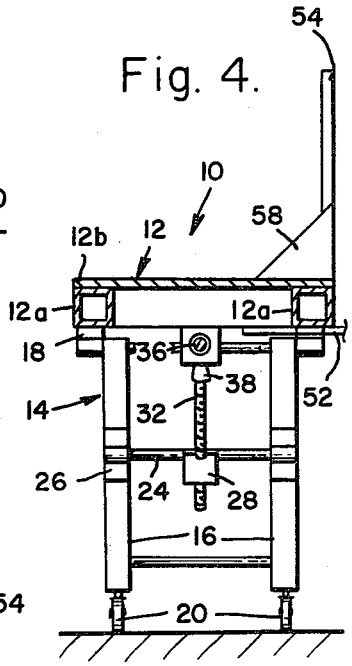
FIG. 4 is a cross-sectional view taken along lines 4—4 of FIG. 1.
Figure 6:
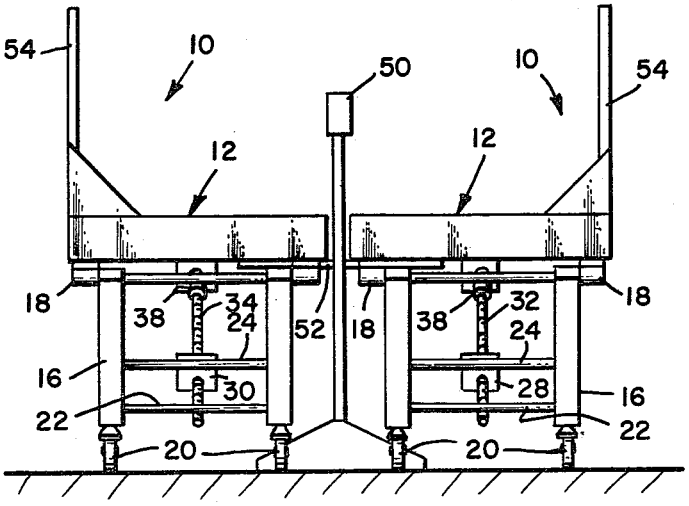
FIG. 6 illustrates the height adjustment feature of the present invention.

Such platforms are particularly useful in combination with a balance beam 50, depicted in FIGS. 5 and 6. In this combination, a pair of platforms 10 is placed on either side of the balance beam and, if desired, the pair of platforms may be tied together by a brace 52, so that a common cable placed over two pulleys 40, one on each platform, will also permit uniform lowering or raising of the platforms with respect to balance beam 50.

To prevent the coach from stepping backwards off of the deck, railings 54 are secured to one side 56 of the deck by bolting and side brackets 58.

Use of the invention may incorporate the following procedure. The beginning gymnast is trained to move in proper sequence and to maintain balance and control on a white line on the floor without use of a beam, or by use of an eight to ten-inch beam, as is conventional. Once the student has learned the necessary control, balance and sequences, including the ability to properly jump off in case she misses the white line, it is possible, with the use of the present invention, for her to move immediately to the competition level using the four-foot balance beam, with the platform operating as a raisable floor. At this level, the student can view the surrounding room and her height at four feet from the floor beyond the ends of the beam and the sides of the platform. At the same time, she is assured that the beam and the platform are at the same level. Also, the coach can stand on either platform next to the student to train the gymnast through her proper sequences and to spot her or catch her in case she falls. Furthermore, the railing at the opposing side of the platform permits the coach to step backwards without fear of falling from the platform.

After the student learns the proper sequences, control and jumps from the balance beam, the platforms may be lowered a few inches, at which point the student continues her practice. Sequential dropping of the platform occurs to about two feet. At that point, the gymnast has obtained sufficient control and proper jumping techniques, along with the necessary confidence, to be able to perform on the balance beam without use of stacked matting and spotting.

While a screw mechanism has been illustrated to effect the height adjustment of the platform, it is to be understood that any means may be used, such as hydraulic, pneumatic, chains and gears, pulleys, and scissor jack mechanisms. In addition, while a springiness or yieldability in the legs is preferred, it may be omitted if a user decides that yieldability is not essential.

Although the invention has been described with reference to a particular embodiment thereof, it should be realized that various changes and modifications may be made therein without departing from the spirit and scope of the invention.

What is claimed is:

1. A pair of platforms in combination with a balance beam for use in training gymnasts, in which each platform comprises:

a generally rectangular deck having an end-to-end length which approximates that of the balance beam and a side-to-side width of lesser dimension than that of the length, so as to enable each said platform at its side to be placed respectively on each side of the balance beam;

two pairs of legs respectively hinged at a first of their paired ends to said deck at its ends, wheels at a second of their leg ends, crossbars respectively pivoted between said paired legs, and nuts respectively coupled to said cross-bars generally at their centers; and means coupled to said nuts for pivoting said leg pairs towards and away from each other and thereby for lowering and raising said deck so as to place each said platform deck at any selected height with respect to the balance beam.

2. A pair of platforms according to claim 1 further comprising an attachment joining said decks for enabling said leg pair pivoting means to lower and raise both said decks in unison.

3. A pair of platforms according to claim 1 in which said legs can flex to impart yieldability to said platforms when said leg pairs are at least partially pivoted towards each other and a force is exerted on the platforms.

4. A pair of platforms according to claim 1 in which said leg pair pivoting means of each said platform comprise screw mechanisms with left- and right-handed threads respectively engaged with said nuts.

5. A pair of platforms according to claim 4 in which each said screw mechanism comprises a shaft with said threads thereon extending between said nuts, and a crank secured to said shaft.

6. A pair of platforms according to claim 4 in which, for each said platform, said screw mechanism comprises a shaft secured in journals to said deck, universal joints at the ends of said shaft, and a pair of screws respectively having said left- and right-handed threads and secured to said universal joints.

7. A pair of platforms according to claim 6 further including a pulley coupled to said shaft for each said platform.

8. A pair of platforms according to claim 1 further including safety railings secured respectively to one side of each of said platforms.

9. A combination of a platform and a balance beam placeable on a surface for use in training gymnasts comprising:

a deck included in said platform and having an end-to-end length which approximates that of the balance beam so as to enable a side of said platform to be placed by a side of the balance beam;

legs on the surface and pivoted at one end to said deck; and means coupled to said legs for pivoting said legs in unison towards and away from each other and thereby for lowering and raising said deck so as to place said deck at any selected height with respect to the balance beam.

10. A combination according to claim 9 in which said legs have limited resiliency for imparting a yielding characteristic to said platform when said legs are at least partially pivoted towards each other.

11. A combination according to claim 9 further including a railing secured to said deck along one side thereof.

12. A combination according to claim 9 in which said leg pivoting means includes internally threaded members coupled to said legs and screw mechanisms with left- and right-handed threads respectively coupled to said threaded members.

13. A combination according to claim 12 in which each of said screw mechanisms comprise a shaft with said threads thereon extending between said threaded members, and a cranking element secured to said shaft.

14. A combination according to claim 12 in which said screw mechanism comprises a shaft secured in journals to said deck, universal joints at the ends of said shaft, and a pair of screws respectively having said threads and secured to said universal joints.

15. A method for training a gymnast on a balance beam set at a predetermined height, comprising the steps of supporting at least one height adjustable substantially rigid platform alongside and at the predetermined height of the balance beam for properly training the gymnast and for enabling a trainer to move about the platform safely during the training, and thence gradually lowering the height of the platform with respect to that of the balance beam in sequential steps while continuing the training at each step.

* * * * *